US006980222B2

(12) United States Patent
Marion et al.

(10) Patent No.: US 6,980,222 B2
(45) Date of Patent: Dec. 27, 2005

(54) METHOD AND APPARATUS FOR IMPLEMENTING DYNAMICALLY SIZABLE COLOR TABLES

(75) Inventors: Neal Richard Marion, Georgetown, TX (US); George Francis Ramsay, III, Cedar Park, TX (US); James Stanley Tesauro, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/755,826

(22) Filed: Jan. 12, 2004

(65) Prior Publication Data

US 2005/0151754 A1 Jul. 14, 2005

(51) Int. Cl.[7] ..... G09G 5/02
(52) U.S. Cl. ..... 345/601; 345/602; 345/543
(58) Field of Search ..... 345/601, 602, 345/603, 593, 543, 544

(56) References Cited

U.S. PATENT DOCUMENTS

| | | | | |
|---|---|---|---|---|
| 4,847,604 A | | 7/1989 | Doyle | 340/706 |
| 5,025,249 A | | 6/1991 | Seiler et al. | 340/721 |
| 5,195,403 A | | 3/1993 | Sani et al. | 76/108.6 |
| 5,218,431 A | | 6/1993 | Gleicher et al. | 358/13 |
| 5,278,678 A | | 1/1994 | Harrington | 358/518 |
| 5,406,310 A | | 4/1995 | Aschenbrenner et al. | 340/703 |
| 5,430,465 A | | 7/1995 | Sabella et al. | 345/199 |
| 5,459,486 A | | 10/1995 | Iverson et al. | 345/153 |
| 5,629,720 A | * | 5/1997 | Cherry et al. | 345/601 |
| 5,629,723 A | | 5/1997 | West et al. | 345/201 |
| 5,673,065 A | | 9/1997 | DeLeeuw | 345/153 |
| 5,703,627 A | | 12/1997 | Young | 345/199 |
| 5,748,176 A | | 5/1998 | Gondek | 345/131 |
| 5,828,779 A | | 10/1998 | Maggioni | 382/165 |
| 5,874,967 A | | 2/1999 | West et al. | 345/435 |
| 5,990,864 A | | 11/1999 | DeAguiar et al. | 345/150 |
| 6,011,540 A | | 1/2000 | Berlin et al. | 345/153 |
| 6,038,374 A | | 3/2000 | Jacob et al. | 395/109 |
| 6,326,974 B1 | | 12/2001 | Satoh et al. | 345/581 |
| 6,466,224 B1 | | 10/2002 | Nagata et al. | 345/592 |
| 6,518,981 B2 | | 2/2003 | Zhao et al. | 345/764 |
| 6,573,904 B1 | | 6/2003 | Chun et al. | 345/629 |
| 6,819,331 B2 | | 11/2004 | Shih et al. | 345/602 |
| 2002/0044150 A1 | | 4/2002 | Sato et al. | 345/600 |
| 2002/0145611 A1 | * | 10/2002 | Dye et al. | 345/543 |

OTHER PUBLICATIONS

U.S. Appl. No. 10/402,110, Marion et al., Method and Apparatus for Dynamically Sizing Color Tables, Mar. 27, 2003.

U.S. Appl. No. 10/402,076, Marion et al., Method and Apparatus for Managing Dynamically Sizeable Color Tables, Mar. 27, 2003.

* cited by examiner

*Primary Examiner*—Matthew Luu
(74) *Attorney, Agent, or Firm*—Duke W. Yee; Marilyn Smith Dawkins; Mari Stewart

(57) ABSTRACT

A method, apparatus, and computer instructions for managing colors in a color table used in displaying graphics. A request is received for a color map. A color map location is set in the color table, wherein the color map location has a starting point. An identification of the starting point for the color map is placed in an entry in a window attribute table. The colors for the color map are loaded into the color table. The starting point of the color map at the color map location is identified using the window attribute table.

18 Claims, 3 Drawing Sheets

METHOD AND APPARATUS FOR IMPLEMENTING DYNAMICALLY SIZABLE COLOR TABLES

CROSS REFERENCE TO RELATED APPLICATIONS

The present invention is related to the following applications entitled: "Method and Apparatus for Managing Dynamically Sizeable Color Tables", Ser. No. 10/402,076, filed Mar. 27, 2003; and "Method and Apparatus for Dynamically Sizing Color Tables", Ser. No. 10/402,110, filed Mar. 27, 2003, and both assigned to the same assignee, and incorporated herein by reference.

BACKGROUND OF THE INVENTION

1. Technical Field

The present invention relates generally to an improved data processing system, and in particular a method and apparatus for processing graphics data. Still more particularly, the present invention provides a method, apparatus, and computer instructions for storing color maps in a data processing system.

2. Description of Related Art

Computer graphics concerns the synthesis or display of real or imaginary objects from computer-based models. In computer graphics systems, images are displayed on a display device to a user in two dimensional and three dimensional forms. These images are displayed using pixels. A pixel is short for a picture element. One spot in a rectilinear grid of thousands of such spots that are individually "painted" to form an image produced on the screen by a computer or on paper by a printer. A pixel is the smallest element that display or print hardware and software can manipulate in creating letters, numbers, or graphics. These pixels and information relating to these pixels are stored in a buffer. The information describing a pixel is identified using a window ID (WID). A WID is used as an index into a window attribute table (WAT). The WAT contains information describing how a pixel will be displayed on the screen. For example, a WAT identifies depth, color map, buffer, and gamma for a pixel.

In displaying pixels, a color table, also referred to as a "color lookup table," is a piece of hardware in which pixel values or colors may be stored. A color map is a list of colors used to display pixels in a window or application. This list of colors must be loaded into a color table to be used. Presently, color tables on a graphics adapter are defined as fixed size tables with the most common size being 256 entries. This size color table is one required to support a fully populated 8-bit color map.

The present invention recognizes that many applications create color maps and only populate the first few entries, leaving many unused color table entries. Typically, each application will use a single color table for its color map. Most adapters provide very few color tables, resulting in the sharing of entries within a color table by applications. Such a sharing of color tables results in technicolor, which causes a window to be displayed with the wrong color map values. In other words, a window may be displayed with the incorrect colors due to a sharing of the color table with multiple applications.

Thus, it would be advantageous to have an improved method, apparatus, and computer instructions for storing colors in a color table.

SUMMARY OF THE INVENTION

The present invention provides a method, apparatus, and computer instructions for managing colors in a color table used in displaying graphics. A request is received for a color map. A color map location is set in the color table, wherein the color map location has a starting point. An identification of the starting point for the color map is placed in an entry in a window attribute table. The colors for the color map are loaded into the color table. The starting point of the color map at the color map location is identified using the window attribute table.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
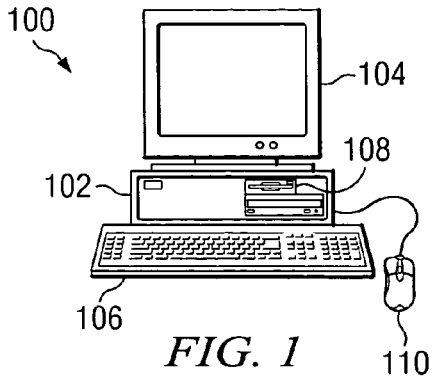
FIG. 1 is a pictorial representation of a data processing system in which the present invention may be implemented in accordance with a preferred embodiment of the present invention.

With reference now to the figures and in particular with reference to FIG. 1, a pictorial representation of a data processing system in which the present invention may be implemented is depicted in accordance with a preferred embodiment of the present invention. A computer 100 is depicted which includes a system unit 102, a video display terminal 104, a keyboard 106, storage devices 108, which may include floppy drives and other types of permanent and removable storage media, and mouse 110. Additional input devices may be included with personal computer 100. Computer 100 can be implemented using any suitable computer, such as an IBM RS/6000 computer or IntelliStation computer, which are products of International Business Machines Corporation, located in Armonk, N.Y. Although the depicted representation shows a computer, other embodiments of the present invention may be implemented in other types of data processing systems, such as a network computer. Computer 100 also preferably includes a graphical user interface that may be implemented by means of systems software residing in computer readable media in operation within computer 100.

Figure 2:
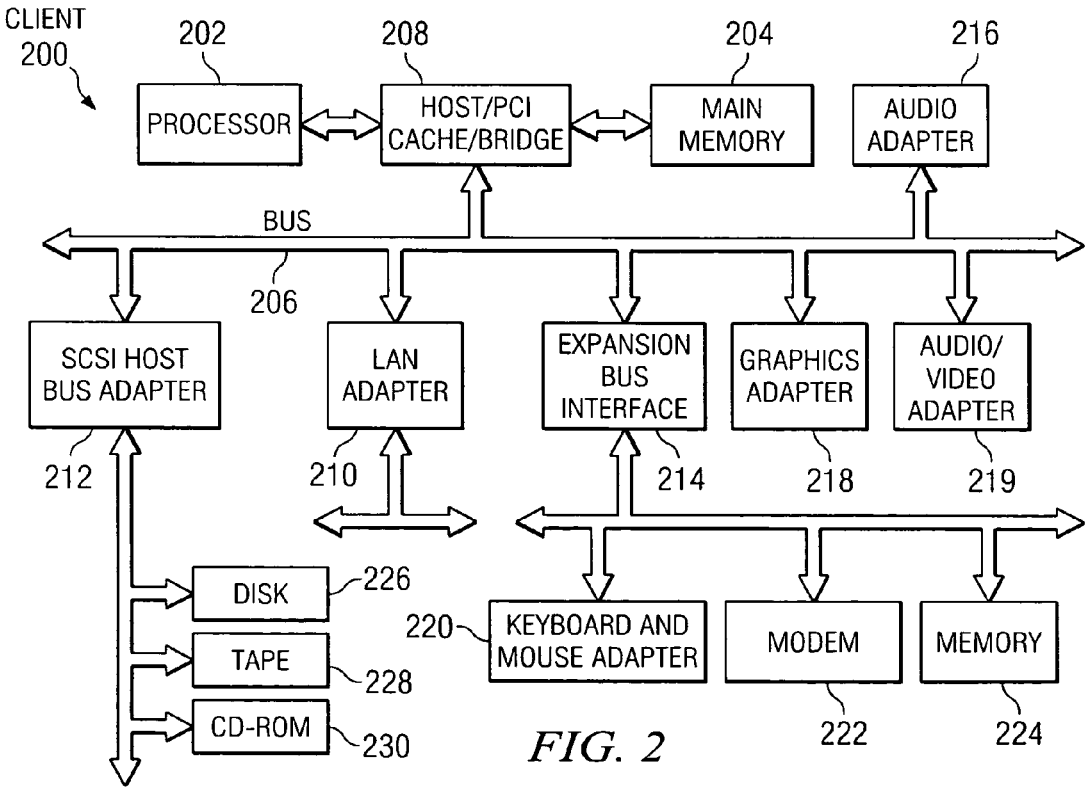
FIG. 2 is a block diagram illustrates a data processing system in which the present invention may be implemented.

With reference now to FIG. 2, a block diagram illustrates a data processing system in which the present invention may be implemented. Data processing system 200 is an example of a computer, such as computer 100 in FIG. 1, in which code or instructions implementing the processes of the present invention may be located. Data processing system 200 employs a peripheral component interconnect (PCI) local bus architecture. Although the depicted example employs a PCI bus, other bus architectures such as Accelerated Graphics Port (AGP) and Industry Standard Architecture (ISA) may be used. Processor 202 and main memory 204 are connected to PCI local bus 206 through PCI bridge 208. PCI bridge 208 also may include an integrated memory controller and cache memory for processor 202. Additional connections to PCI local bus 206 may be made through direct component interconnection or through add-in boards. In the depicted example, local area network (LAN) adapter 210, small computer system interface SCSI host bus adapter 212, and expansion bus interface 214 are connected to PCI local bus 206 by direct component connection. In contrast, audio adapter 216, graphics adapter 218, and audio/video adapter 219 are connected to PCI local bus 206 by add-in boards inserted into expansion slots. The processes of the present invention may be used to manage rendering of data by graphics adapter 218 or audio/video adapter 219.

Expansion bus interface 214 provides a connection for a keyboard and mouse adapter 220, modem 222, and additional memory 224. SCSI host bus adapter 212 provides a connection for hard disk drive 226, tape drive 228, and CD-ROM drive 230. Typical PCI local bus implementations will support three or four PCI expansion slots or add-in connectors.

An operating system runs on processor 202 and is used to coordinate and provide control of various components within data processing system 200 in FIG. 2. The operating system may be a commercially available operating system such as Windows XP, which is available from Microsoft Corporation. Instructions for the operating system and applications or programs are located on storage devices, such as hard disk drive 226, and may be loaded into main memory 204 for execution by processor 202.

Those of ordinary skill in the art will appreciate that the hardware in FIG. 2 may vary depending on the implementation. Other internal hardware or peripheral devices, such as flash ROM (or equivalent nonvolatile memory) or optical disk drives and the like, may be used in addition to or in place of the hardware depicted in FIG. 2. Also, the processes of the present invention may be applied to a multiprocessor data processing system.

For example, data processing system 200, if optionally configured as a network computer, may not include SCSI host bus adapter 212, hard disk drive 226, tape drive 228, and CD-ROM 230. In that case, the computer, to be properly called a client computer, must include some type of network communication interface, such as LAN adapter 210, modem 222, or the like. As another example, data processing system 200 may be a stand-alone system configured to be bootable without relying on some type of network communication interface, whether or not data processing system 200 comprises some type of network communication interface. As a further example, data processing system 200 may be a Personal Digital Assistant (PDA) device which is configured with ROM and/or flash ROM in order to provide nonvolatile memory for storing operating system files and/or user-generated data.

The depicted example in FIG. 2 and above-described examples are not meant to imply architectural limitations. For example, data processing system 200 also may be a notebook computer or hand held computer in addition to taking the form of a PDA. Data processing system 200 also may be a kiosk or a Web appliance.

Figure 3:
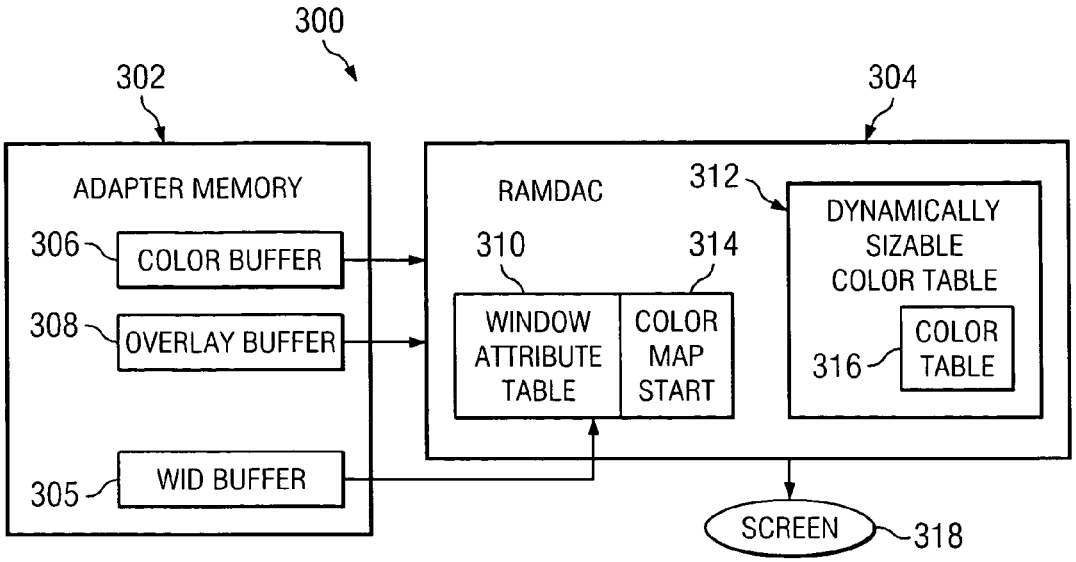
FIG. 3 is a block diagram illustrating a graphics adapter in accordance with a preferred embodiment of the present invention.

Turning next to FIG. 3, a block diagram illustrating a graphics adapter is depicted in accordance with a preferred embodiment of the present invention. Graphics adapter 300 is an example of a graphics adapter, such as graphics adapter 218 in FIG. 2.

In this example, graphics adapter 300 includes an adapter memory 302 and a random access memory digital to analog converter (RAMDAC) 304. Adapter memory 302 contains window ID (WID) buffer 305, color frame buffer 306, and overlay frame buffer 308. RAMDAC 304 includes window attribute table (WAT) table 310 and dynamically sizable color table 312. Window attribute table 310 includes color map start fields 314. Dynamically sizable color table 312 contains color table 316. The two frame buffers, color frame buffer 306 and overlay frame buffer 308, contain pixels, which are sent to RAMDAC 304 for output to a display device, such as screen 318. RAMDAC 304 is a graphics controller chip that maintains the color palette and converts data from memory into analog signals for a display device. The color palette takes the form of color maps and is maintained within dynamically sizable color table 312.

In these examples, a dynamic color table is provided, dynamically sizable color table 312, to facilitate a more efficient use of space within this color table. The mechanism of the present invention allows for dynamically changing the entries provided for color maps. The location of the start points for different color maps are controlled through color map start fields 314, which is located in window attribute table 310. This information contains the actual color map start point, which is in these examples the address at which the color map starts. The information is written into these fields to provide an identification of where color maps begin in color table 312. When window attribute table 310 is accessed, the appropriate color map within color table 316 may be identified by the color map start location identified in the color map start field for the particular entry in window attribute table 310. In these examples, the color map start location is an address in color table 312. By providing the actual color map start point, the complexity and size of RAMDAC 304 may be reduced, while maintaining an ability to subdivide color table 312.

Using the mechanism of the present invention, a single color table may be employed to hold or contain multiple color maps in which the color maps are assigned only the space needed. In this manner, problems, such as technicolor, maybe avoided with limited numbers of color tables in a graphics adapter. For example, if a single color map uses only eight colors, only eight color table entries are needed instead of a full 256 entry color table. Previously, such a color map would require the use of the entire 256 color table because no mechanism was provided for dynamically sizing within the color table. With the present invention, the remaining entries in the color table are available for use by other color maps.

Figure 4:
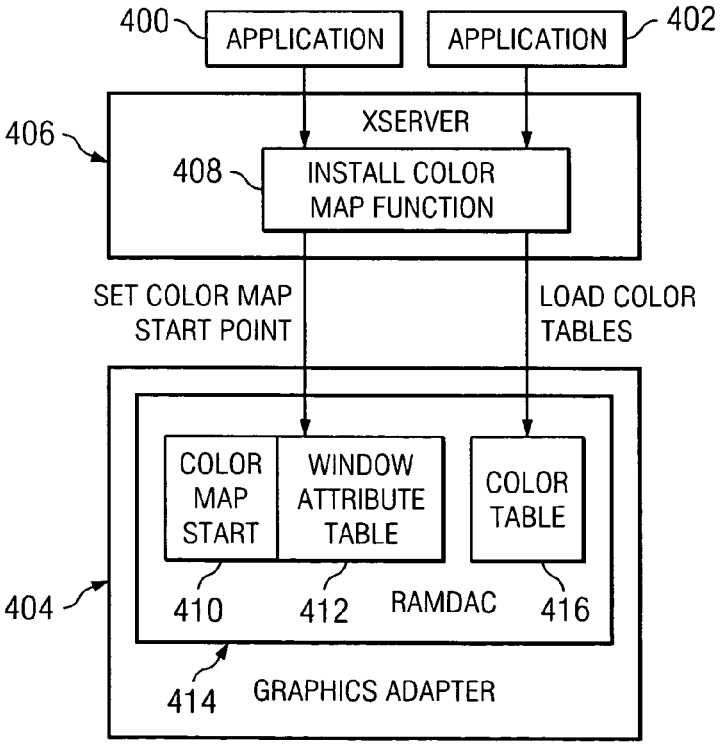
FIG. 4 is a diagram illustrating components and data flow used in dynamically sizing a color table in accordance with a preferred embodiment of the present invention.

Turning next to FIG. 4, a diagram illustrating components and data flow used in dynamically sizing a color table are depicted in accordance with a preferred embodiment of the present invention.

Application 400 and application 402 may generate requests to install color maps in graphics adapter 404 to display colors for windows. These requests are sent to Xserver 406 and are processed by install color map function 408 in Xserver 406. An Xserver is a graphics device driver that displays an application, such as application 400 or 402 on a display device. In this example, Xserver 406 processes requests from both local and remote applications. The results of this processing are displayed on a screen by this driver.

The requests are processed to identify the number of entries needed in a color table for each color map. The start point and size for color maps are stored and maintained in Xserver 406 by install color map function 408 in these illustrative example. In response to identifying the number of entries needed, install color map function 408 sets the appropriate color map start point and writes that information into color map start fields 410, which is located within window attribute table 412, which is located in RAMDAC 414 in graphics adapter 404.

Based on the location and size set for the color maps, install color map function 408 then loads the color maps into color table 416 in RAMDAC 414. The size of the color tables may be stored in Xserver 406 with those size values being accessed by install color map function 408. The color map start location loaded into window attribute table 412 is the same information stored by install color map function 408. This information is used by the hardware to locate the color map. Xserver 406 installs the color map into color table 416 based on the location and size information kept by Xserver 406.

In this manner, the mechanism of the present invention allows for multiple color maps of different sizes to be placed into color table 414 through dynamic sizing within color table 414. As a result, color table 414 is in essence multiple color tables in which each of these color tables have sizes that are created to support different sized color maps.

Depending on the particular implementation, the size of the color maps also may be stored within window attribute table 412. By storing this size information in Xserver 406, however, a performance gain is obtained because the graphics driver in Xserver 406 no longer has to read data across a bus to obtain this information.

Figure 5:
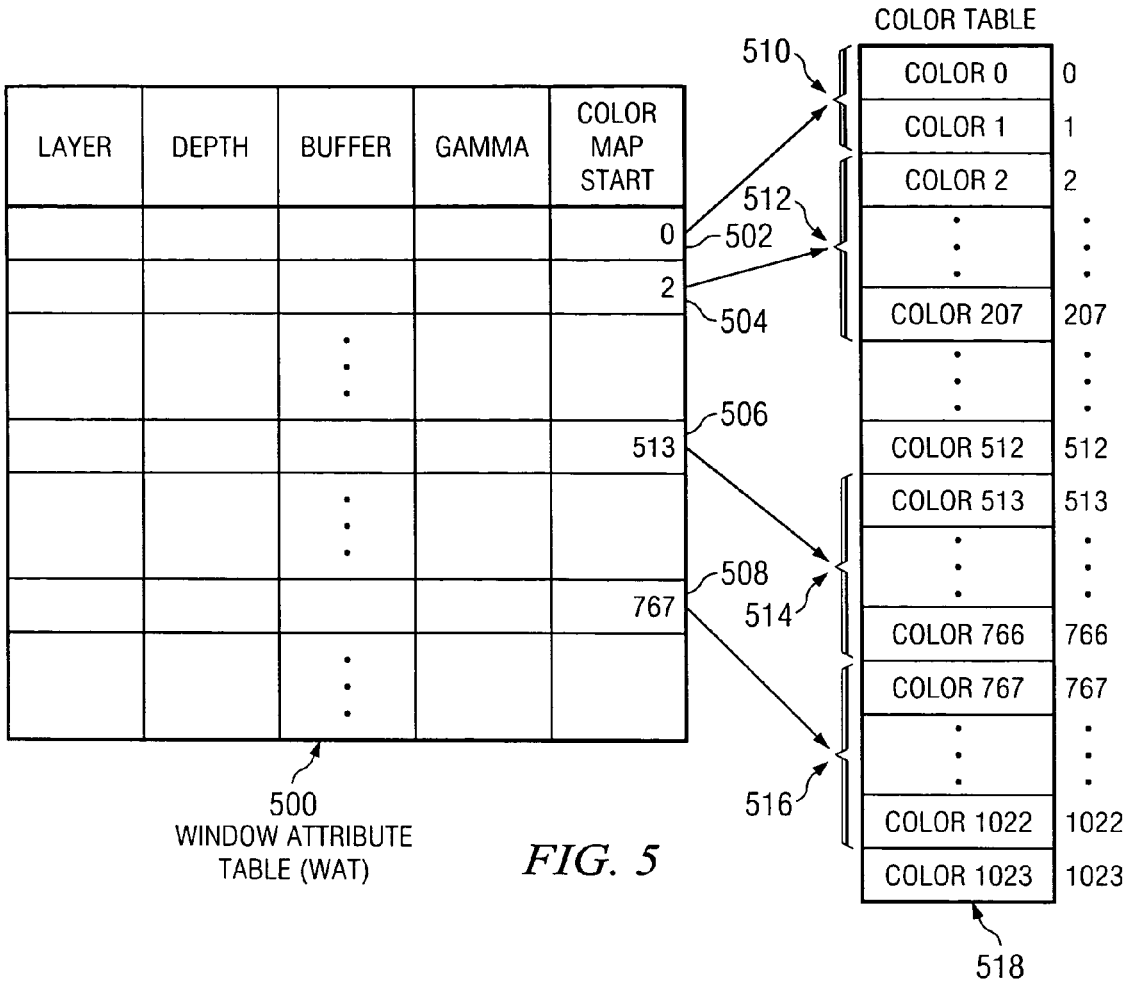
FIG. 5 is a diagram illustrating a window attribute table including color map start points in accordance with a preferred embodiment of the present invention.

Turning next to FIG. 5, a diagram illustrating a window attribute table including color map start points is depicted in accordance with a preferred embodiment of the present invention. Window attribute table 500 is an example of window attribute table 412 in FIG. 4. As illustrated, start points for four color maps are shown in window attribute table 500.

Window attribute table 500 contains fields for data, such as layer, depth, buffer, gamma, and color map start in each entry. In this illustrative example, entries 502, 504, 506, and 508 contain color map start points corresponding to color maps in sections 510, 512, 514, and 516 within color table 518. Color table 518 is an example of a color table such as color table 416 in FIG. 4.

The start point for the color map in section 510 begins at address 0 as identified in the color map start field in entry 502. The color map start field in entry 504 indicates a start address of 2 for the color map in section 512. The color map in section 514 begins at address 513 as indicated by the color map start field in entry 506 in window attribute table 500. Finally, the color map start field in entry 508 indicates a start address of 767 for the color map in section 516 of color table 518.

Figure 6:
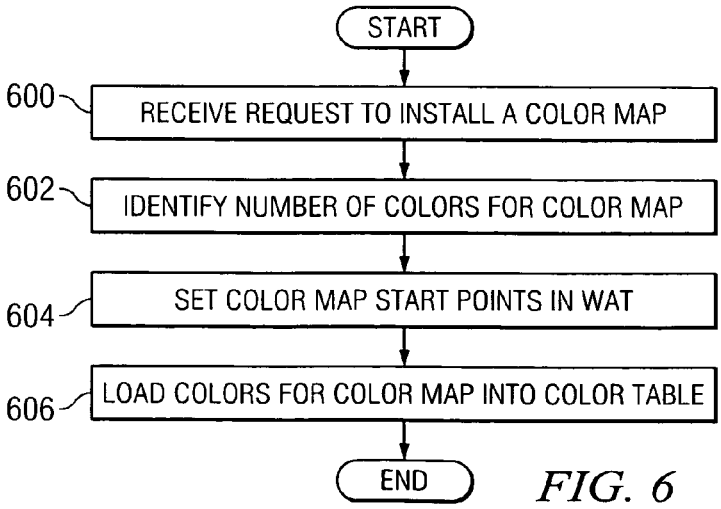
FIG. 6 is a flowchart of a process for dynamically loading color maps into a dynamically sized color table in accordance with a preferred embodiment of the present invention.

Turning now to FIG. 6, a flowchart of a process for dynamically loading color maps into a dynamically sized color table is depicted in accordance with a preferred embodiment of the present invention. The process illustrated in FIG. 6 may be in a graphics process such as Xserver 406 in FIG. 4.

The process begins by receiving a request to install a color map (step 600). This request is typically received from an application or window manager. The application or window manager passes in a color map identifier to the process. With this identifier, internal color map structures may be accessed to see how many colors the color map has, the actual colors, and if the colors are already loaded into the color table. Based on the requests received, a number of colors for the color maps are identified (step 602). A color map start point is set in the color map start field in the window attribute table (step 604). The color map start point is determined when the number of colors needed is identified. In these examples, the number of colors equals the number of entries needed in the color table. The location and size are selected by the install color map function. The start point is set in the window attribute table in the RAMDAC. Thereafter, the colors for the color map are loaded into the color table (step 606) with the process terminating thereafter.

Thus, the present invention provides a method, apparatus, and computer instructions for managing color tables in a graphics adapter. The mechanism of the present invention allows for dynamic sizing within a color table to allow for multiple color maps to be placed within the color table. Each color map is allocated only with as much space as needed for a particular color map, rather than a set allocation. For example, if a color map only includes two colors, only two entries are allocated, while a color map having 256 colors is allocated 256 entries. This mechanism does not require any changes or modifications to applications requesting color maps. Instead, an extra field is provided in each entry in a window attribute table to identify the start location of a color map that is to be used for that particular entry. With this mechanism, improved efficiency in color table usage is provided, reducing the need to implement large numbers of expensive color tables. Further, this mechanism provides improved usability over current color tables, reducing the occurrence of technicolor.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMS, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method in a data processing system for managing colors in a color table used in displaying graphics, the method comprising:

receiving a request for a color map from a set of color maps in the color table;

determining a color map location in the color table, wherein the color map location has a starting point in the color table;

placing an identification of the starting point for the color map in an entry in a window attribute table, wherein the window attribute table includes a starting point for each color map present in the color table; and loading the colors for the color map into the color table at the color map location, wherein the starting point of the color map at the color map location is identified using the window attribute table, and wherein multiple color maps of different sizes in the color table are managed.

2. The method of claim 1, wherein the starting point for the color map is an address.

3. The method of claim 1 further comprising:

setting the location and a size for the color map in the color table based on the number of entries for the color map.

4. The method of claim 1 further comprising:

receiving a second request for a second color map;

determining a second color map location in the color table, wherein the second color map has a second starting point in the color table;

placing an identification of the second starting point for the second color map in a second entry in the window attribute table; and loading the colors for the second color map into the color table at the second color map location, wherein the starting point of the second color map at the second color map location is identified using the window attribute table.

5. The method of claim 1, wherein the color table is located in the graphics adapter.

6. A data processing system for managing colors in a color table used in displaying graphics, the data processing system comprising:

receiving means for receiving a request for a color map from a set of color maps in the color table;

determining means for determining a color map location in the color table, wherein the color map location has a starting point in the color table;

placing means for plating an identification of the starting point for the color map in an entry in a window attribute table, wherein the window attribute table includes a starting point for each color map present in the color table; and loading means for loading the colors for the color map into the color table at the color map location, wherein the starting point of the color map at the color map location is identified using the window attribute table, and wherein multiple color maps of different sizes in the color table are managed.

7. The data processing system of claim 6, wherein the starting point for the color map is an address.

8. The data processing system of claim 6 further comprising:

setting means for setting the location and a size for the color map in the color table based on the number of entries for the color map.

9. The data processing system of claim 6 further comprising:

receiving means for receiving a second request for a second color map;

determining means for determining a second color map location in the color table, wherein the second color map has a second starting point in the color table;

placing means for placing an identification of the second starting point for the second color map in a second entry in the window attribute table; and loading means for loading the colon for the second color map into the color table at the second color map location, wherein the starting point of the second color map at the second color map location is identified using the window attribute table.

10. The data processing system of claim 6, wherein the color table is located in the graphics adapter.

11. A computer program product comprising a computer usable medium having computer usable program code for managing colors in a color table used in displaying graphics, the computer program product including;

computer usable program code for receiving a request for a color map from a set of color maps in the color table;

computer usable program code for determining a color map location in the color table, wherein the color map location has a starting point in a color table;

computer usable program code for placing an identification of the starting point for the color map in an entry in a window attribute table, wherein the window attribute table includes a starting point for each color map present in the color table; and computer usable program code for loading the colors for the color map into the color table at the color map location, wherein the starting point of the color map at the color map location is identified using the window attribute table, and wherein multiple color maps of different sizes in the color table are managed.

12. The computer program product of claim 11, wherein the starting point for the color map is an address.

13. The computer program product of claim 11 further comprising:

fifth instructions for setting the location and a size for the color map in the color table based on the number of entries for the color map.

14. The computer program product of claim 11 further comprising:

sixth instructions for receiving a second request for a second color map;

seventh instructions for determining a second color map location in the color table, wherein the second color map has a second starting point in the color table;

eighth instructions for placing an identification of the second starting point for the second color map in a second entry in the window attribute table; and ninth instructions for loading the colors for the second color map into the color table at the second color map location, wherein the starting point of the second color map at the second color map location is identified using the window attribute table.

15. The computer program product of claim 11, wherein to color table is located in the graphics adapter.

16. The method of claim 1 further comprising:

receiving a subsequent request for an additional color map;

determining a new color map location in the color table, wherein the new color map location has a new starting point in the color table;

placing an identification of the new starting point for the additional color map in a new entry in the window attribute table; and loading the colors for the additional color map into the color table at the new color map location, wherein the new starting point of the additional color map at the new color map location is identified using the window attribute table.

17. The data processing system of claim 6 further comprising:

receiving means for receiving a subsequent request for an additional color map;

determining means for determining a new color map location in the color table, wherein the new color map location has a new starting point in the color table;

placing means for placing an identification of the new starting point for the additional color map in a new entry in the window attribute table; and loading means for loading the colors for the additional color map into the color table at the new color map location, wherein the new starting point of the additional color map at the new color map location is identified using the window attribute table.

18. The computer program product of claim 11, further comprising:

computer usable program code for receiving a subsequent request for an additional color map;

computer usable program code for determining a new color map location in the color table, wherein the new color map location has a new starting point in the color table;

computer usable program code for placing an identification of the new starting point for the additional color map in a new entry in the window attribute table; and computer usable program code for loading the colors for the additional color map into the color table at the new color map location, wherein the new starting point of the additional color map at the new color map location is identified using the window attribute table.

* * * * *